US011371755B2

(12) United States Patent
Maruyama et al.

(10) Patent No.: US 11,371,755 B2
(45) Date of Patent: Jun. 28, 2022

(54) AIR-CONDITIONING APPARATUS

(71) Applicant: Mitsubishi Electric Corporation, Tokyo (JP)

(72) Inventors: Hiroki Maruyama, Tokyo (JP); Osamu Morimoto, Tokyo (JP); Hiroyuki Okano, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/640,871

(22) PCT Filed: Sep. 15, 2017

(86) PCT No.: PCT/JP2017/033439
§ 371 (c)(1),
(2) Date: Feb. 21, 2020

(87) PCT Pub. No.: WO2019/053876
PCT Pub. Date: Mar. 21, 2019

(65) Prior Publication Data

US 2020/0182516 A1 Jun. 11, 2020

(51) Int. Cl.
*F25B 13/00* (2006.01)
*F24F 11/81* (2018.01)
(Continued)

(52) U.S. Cl.
CPC ..... *F25B 13/00* (2013.01); *F24F 11/81* (2018.01); *F24F 11/83* (2018.01); *F25B 1/10* (2013.01);
(Continued)

(58) Field of Classification Search
CPC .... F25B 13/00; F25B 1/10; F25B 2313/0231; F25B 2313/0252; F25B 2313/02741;
(Continued)

(56) References Cited

U.S. PATENT DOCUMENTS 5,142,879 A * 9/1992 Nakamura ..... F25B 13/00 62/160
2013/0118197 A1* 5/2013 Kibo ..... F25B 49/02 62/222
(Continued)

FOREIGN PATENT DOCUMENTS

CN 104053959 A 9/2014
EP 2 808 621 A1 12/2014
(Continued)

OTHER PUBLICATIONS

Chiaki et al., Multiple Air Conditioner, Mar. 29, 1991, JPH0375459A, Whole Document (Year: 1991).*
(Continued)

*Primary Examiner* — Larry L Furdge
(74) *Attorney, Agent, or Firm* — Posz Law Group, PLC

(57) ABSTRACT

An air-conditioning apparatus that includes a compressor, a flow switching device, an outdoor heat exchange unit, an expansion section and an indoor heat exchanger, which are connected by pipes, in which the outdoor heat exchange unit includes a first outdoor heat exchanger, a first flow rate control device, a second outdoor heat exchanger, a second flow rate control device, a bypass pipe, the second outdoor heat exchanger, the second flow rate control device, a third flow rate control device, and a flow control device.

9 Claims, 4 Drawing Sheets

(51) Int. Cl.
*F24F 11/83* (2018.01)
*F25B 1/10* (2006.01)

(52) U.S. Cl.
CPC ..... *F25B 2313/0231* (2013.01); *F25B 2313/0252* (2013.01); *F25B 2313/02741* (2013.01)

(58) Field of Classification Search
CPC ..... F25B 2313/0233; F25B 2500/07; F25B 2313/0294; F25B 2700/21152; F25B 2500/31; F25B 2600/2501; F25B 2700/1933; F25B 2600/0271; F25B 2700/1931; F25B 2600/2513; F25B 49/02; F25B 2313/0272; F24F 11/81; F24F 11/83; F24F 2140/00
See application file for complete search history.

(56) References Cited

U.S. PATENT DOCUMENTS

| | | | | |
|---|---|---|---|---|
| 2014/0360218 | A1* | 12/2014 | Takenaka | F25B 13/00 62/324.6 |
| 2015/0176848 | A1* | 6/2015 | Jung | F24F 3/065 165/221 |
| 2016/0161163 | A1 | 6/2016 | Hung | |

FOREIGN PATENT DOCUMENTS

| | | | | |
|---|---|---|---|---|
| JP | H0375459 | A | * | 3/1991 |
| JP | H08-178447 | A | | 7/1996 |
| JP | H08247561 | A | * | 9/1996 |
| JP | H1047797 | A | * | 2/1998 |
| JP | H10267431 | A | * | 10/1998 |
| JP | H11-264620 | A | | 9/1999 |
| JP | 2009-121707 | A | | 6/2009 |
| JP | 2011-106702 | A | | 6/2011 |
| WO | 2013/111176 | A1 | | 8/2013 |

OTHER PUBLICATIONS

Eguchi et al., Air Conditioner, Feb. 20, 1998, JPH1047797A, Whole Document (Year: 1998).*

Osada et al., Air Conditioner, Sep. 27, 1996, JPH08247561A, Whole Document (Year: 1996).*

Kobayashi et al., Outdoor Unit for Multitype Heat Pump Type Air Conditioner, Oct. 9, 1998, JPH10267431A, Whole Document (Year: 1998).*

Extended European Search Report dated Jul. 29, 2020 issued in corresponding EP patent application No. 17925484.2.

Office Action dated Oct. 6, 2020 issued in corresponding JP patent application No. 2019-541594 (and English translation).

International Search Report of the International Searching Authority dated Nov. 21, 2017 in corresponding International Patent Application No. PCT/JP2017/033439 (and English translation).

Chinese Office Action dated Dec. 3, 2020 issued in corresponding CN Patent Application No. 201780094362.3 (and Machine Translation).

Office Action dated Jun. 4, 2021 issued in corresponding CN patent application No. 201780094362.3 ( and English translation).

Decision of Rejection dated Oct. 9, 2021, issued in corresponding CN Patent Application No. 201780094362.3 (and English Machine Translation).

* cited by examiner

AIR-CONDITIONING APPARATUS

CROSS REFERENCE TO RELATED APPLICATION

This application is a U.S. national stage application of PCT/JP2017/033439 filed on Sep. 15, 2017, the contents of which are incorporated herein by reference.

TECHNICAL FIELD

The present disclosure relates to an air-conditioning apparatus in which a heat exchange amount of an outdoor heat exchanger is controlled.

BACKGROUND ART

Up to date, there has been known an air-conditioning apparatus that controls a heat exchange amount of an outdoor heat exchanger in response to an operation load (refer to Patent Literature 1, for example). Patent Literature 1 discloses an air-conditioning apparatus that includes an outdoor fan, an outdoor heat exchanger, an outdoor side flow rate control device connected in series to the outdoor heat exchanger, and a bypass flow rate control device provided on a bypass pipe bypassing the outdoor heat exchanger and the outdoor side flow rate control device. In Patent Literature 1, the heat exchange amount of the outdoor heat exchanger is controlled by air flow adjustment of the outdoor fan and flow rate adjustment using an expansion valve, during cooling operation.

CITATION LIST

Patent Literature

Patent Literature 1: International Publication No. WO2013/111176

SUMMARY OF INVENTION

Technical Problem

The air-conditioning apparatus disclosed in Patent Literature 1 decreases the heat exchange amount of the outdoor heat exchanger by throttling the opening degree of the outdoor flow rate control device downstream of the outdoor heat exchanger during cooling operation. Therefore, an amount of refrigerant flowing out from the outdoor heat exchanger is smaller than an amount of refrigerant discharged from a compressor, and therefore the refrigerant accumulates in the outdoor heat exchanger. Accordingly, a circulation amount of the refrigerant that is necessary for an operation of the air-conditioning apparatus becomes insufficient.

To solve the problem as described above, the present disclosure provides an air-conditioning apparatus that ensures a circulation amount of refrigerant that is necessary for operation even when decreasing a heat exchange amount.

Solution to Problem

An air-conditioning apparatus according to an embodiment of the present disclosure is an air-conditioning apparatus including a compressor, a flow switching device, an outdoor heat exchange unit, an expansion section and an indoor heat exchanger, which are connected by pipes, in which the outdoor heat exchange unit includes a first outdoor heat exchanger connected to the flow switching device, a first flow rate control device connected in series to the first outdoor heat exchanger, a second outdoor heat exchanger connected in parallel with the first outdoor heat exchanger and the first flow rate control device, a second flow rate control device connected in series to the second outdoor heat exchanger, a bypass pipe configured to bypass the first outdoor heat exchanger and the first flow rate control device, and the second outdoor heat exchanger and the second flow rate control device, a third flow rate control device provided in the bypass pipe, and a flow rate adjustment device connected between a discharge side of the compressor and the second outdoor heat exchanger.

Advantageous Effects of Invention

According to an embodiment of the present disclosure, in order to decrease heat exchange amounts of the first outdoor heat exchanger and the second outdoor heat exchanger, the first flow rate control device, the second flow rate control device and the flow control device are controlled. Consequently, even when the amount of refrigerant flowing out from the second outdoor heat exchanger decreases, the amount of the refrigerant can be made up by increasing the amount of refrigerant flowing to the bypass pipe. Accordingly, a circulation amount of the refrigerant necessary for operation can be secured even when the heat exchange amounts are decreased.

DESCRIPTION OF EMBODIMENTS

Embodiment 1

Figure 1:
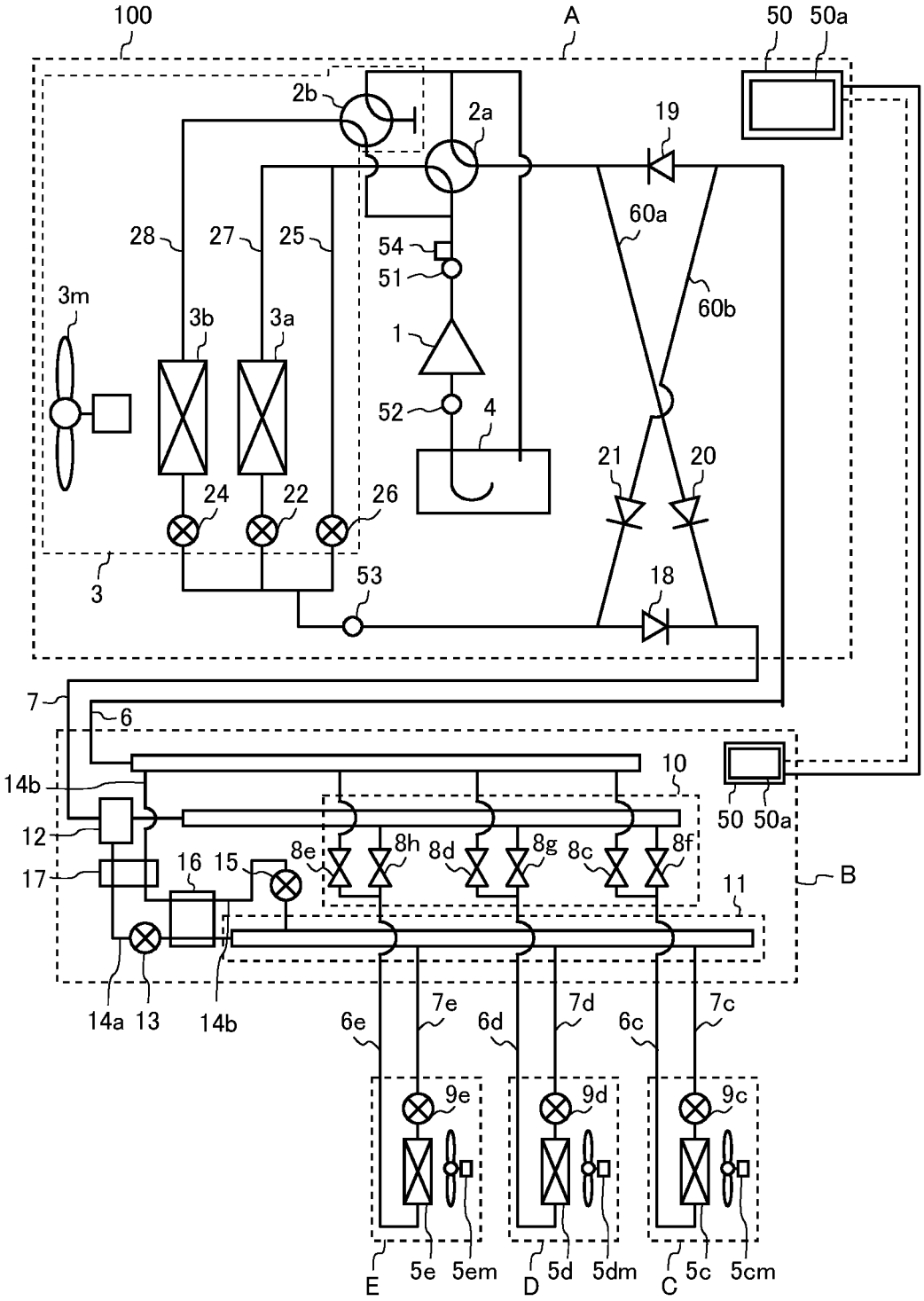
FIG. 1 is a circuit diagram illustrating an air-conditioning apparatus 100 according to Embodiment 1 of the present disclosure.

An embodiment of the air-conditioning apparatus according to the present disclosure will be described hereinafter with reference to the drawings. FIG. 1 is a circuit diagram illustrating an air-conditioning apparatus 100 according to Embodiment 1 of the present disclosure. As illustrated in FIG. 1, the air-conditioning apparatus 100 is capable of performing a cooling and heating mixed operation that simultaneously performs a cooling operation and a heating operation by allowing a cooling mode or a heating mode to be freely selected in respective indoor units C to E by using a refrigeration cycle. As illustrated in FIG. 1, the air-conditioning apparatus 100 has one outdoor unit A, a plurality of indoor units C to E that are connected in parallel with one another, and a relay B interposed between the outdoor unit A, and the indoor units C to E. Note that in the present Embodiment 1, a case where the one relay B and the three indoor units C to E are connected to the one outdoor unit A is illustrated, but the respective numbers of units that are connected are not limited to the illustrated numbers. The air-conditioning apparatus 100 may include, for example, two or more outdoor units A, two or more relays B, one, two or four or more indoor units C to E.

The outdoor unit A and the relay B are connected by a first refrigerant pipe 6 and a second refrigerant pipe 7. The relay B and the indoor unit C are connected by a first indoor unit side refrigerant pipe 6*c* near an indoor unit C and a second indoor unit side refrigerant pipe 7*c* near the indoor unit C. The relay B and the indoor unit D are connected by a first indoor unit side refrigerant pipe 6*d* near the indoor unit D and a second indoor unit side refrigerant pipe 7*d* near the indoor unit D. The relay B and the indoor unit E are connected by a first indoor unit side refrigerant pipe 6*e* near the indoor unit E and a second indoor unit side refrigerant pipe 7*e* near the indoor unit E. The first refrigerant pipe 6 is a pipe of a large diameter connecting a flow switching device 2*a* and the relay B. The first indoor unit side refrigerant pipe 6*c* near the indoor unit C connects an indoor heat exchanger 5*c* of the indoor unit C and the relay B, and is a pipe branched from the first refrigerant pipe 6. The first indoor unit side refrigerant pipe 6*d* near the indoor unit D connects an indoor heat exchanger 5*d* of the indoor unit D and the relay B, and is a pipe branched from the first refrigerant pipe 6. The first indoor unit side refrigerant pipe 6*e* near the indoor unit E connects an indoor heat exchanger 5*e* of the indoor unit E and the relay B, and is a pipe branched from the first refrigerant pipe 6. The second refrigerant pipe 7 connects an outdoor heat exchange unit 3 and the relay B, and is a pipe having a diameter smaller than the diameter of the first refrigerant pipe 6. The second indoor unit side refrigerant pipe 7*c* on the outdoor unit C side connects the indoor heat exchanger 5*c* of the indoor unit C and the relay B, and is a pipe branched from the second refrigerant pipe 7. The second indoor unit side refrigerant pipe 7*d* near the indoor unit D connects the indoor heat exchanger 5*d* of the indoor unit D and the relay B, and is a pipe branched from the second refrigerant pipe 7. The second indoor unit side refrigerant pipe 7*e* near the indoor unit E connects the indoor heat exchanger 5*e* of the indoor unit E and the relay B, and is a pipe branched from the second refrigerant pipe 7.

(Outdoor Unit A)

The outdoor unit A is usually disposed in a space such as a rooftop outside of a structure such as a building, and supplies cooling energy or heating energy to the indoor units C to E via the relay B. Note that the outdoor unit A may be installed in an enclosed space such as a machine room where a ventilation hole is formed, for example, without being limited to the case of being installed outdoor. Further, the outdoor unit A may be installed inside of a structure when waste heat can be exhausted to outside of the structure with an exhaust duct. Furthermore, the outdoor unit A may be installed inside of the structure as a water-cooled type outdoor unit.

The outdoor unit A contains a compressor 1, a flow switching device 2*a* configured to switch a refrigerant circulation direction of the outdoor unit A, an outdoor heat exchange unit 3 and an accumulator 4. The compressor 1, the flow switching device 2*a*, a flow rate adjustment device 2*b*, the outdoor heat exchange unit 3 and the accumulator 4 are connected by the first refrigerant pipe 6 and the second refrigerant pipe 7.

Here, the outdoor heat exchange unit 3 has a first outdoor heat exchanger 3*a*, a first flow rate control device 22, a second outdoor heat exchanger 3*b*, a second flow rate control device 24, a third flow rate control device 26, and the flow rate adjustment device 2*b*. Here, the outdoor heat exchange unit 3 is provided with a first pipe 27, a second pipe 28 and a bypass pipe 25. The first pipe 27 is provided with the first outdoor heat exchanger 3*a*, and the first flow rate control device 22 connected to the first outdoor heat exchanger 3*a*. The second pipe 28 is provided with the second outdoor heat exchanger 3*b*, and the second flow rate control device 24 connected to the second outdoor heat exchanger 3*b*. The bypass pipe 25 is provided with the third flow rate control device 26.

Further, in the vicinity of the first outdoor heat exchanger 3*a* and the second outdoor heat exchanger 3*b*, an outdoor flow rate control device 3*m* controlling a flow rate of outdoor air that is a fluid exchanging heat with refrigerant is installed. In the present Embodiment 1, explanation is made by using air-cooling type outdoor heat exchangers as examples of the first outdoor heat exchanger 3*a* and the second outdoor heat exchanger 3*b*, and using an outdoor fan as an example of the outdoor flow rate control device 3*m*. The first outdoor heat exchanger 3*a* and the second outdoor heat exchanger 3*b* may be any outdoor heat exchanger such as of a water-cooling type as long as refrigerant exchanges heat with another fluid. In this case, as the outdoor flow rate control device 3*m*, a pump is used. In the present Embodiment 1, a case where the two outdoor heat exchangers are provided is illustrated, but three or more outdoor heat exchangers may be provided. In this case, each of the outdoor heat exchangers is provided with a flow rate control device.

Further, the outdoor unit A is provided with a first connection pipe 60*a*, a second connection pipe 60*b*, a check valve 18, a check valve 19, a check valve 20 and a check valve 21. By the first connection pipe 60*a*, the second connection pipe 60*b*, the check valve 18, the check valve 19, the check valve 20 and the check valve 21, high-pressure refrigerant flows out from an inside of the indoor unit A via the second refrigerant pipe 7 regardless of a connection direction of the flow switching device 2*a*, and the flow rate adjustment device 2*b*. Further, by the first connection pipe 60*a*, the second connection pipe 60*b*, the check valve 18, the check valve 19, the check valve 20 and the check valve 21, low-pressure refrigerant flows into the outdoor unit A via the first refrigerant pipe 6.

The compressor 1 suctions refrigerant, compresses the refrigerant and brings the refrigerant into a high-temperature and high-pressure state, and is made up of an inverter compressor or other compressors capable of performing capacity control, for example.

The flow switching device 2*a* and the flow rate adjustment device 2*b* switch a flow of refrigerant during heating operation, and a flow of refrigerant during cooling operation. The flow switching device 2*a* switches two connection states. One of the connection states is a connection state where the first pipe 27 and the bypass pipe 25 are connected to a discharge side of the compressor 1, and the indoor heat exchangers 5*c* to 5*e* are connected to the accumulator 4 provided at a suction side of the compressor 1. The other connection state is a connection state where the first pipe 27 and the bypass pipe 25 are connected to the accumulator 4 provided at the suction side of the compressor 1, and the discharge side of the compressor 1 is connected to the indoor heat exchangers 5*c* to 5*e*.

The flow rate adjustment device 2*b* is connected between the discharge side of the compressor 1 and the second outdoor heat exchanger 3*b*, and is a four-way switching valve switching a flow of refrigerant flowing to the second outdoor heat exchanger 3*b*, for example. Note that the flow rate adjustment device 2*b* may be an on-off valve that shuts off the flow of refrigerant, or may be a flow rate adjustment valve that controls the flow rate of refrigerant linearly. The flow rate adjustment device 2*b* switches two connection states. One of the connection states is a connection state where the second pipe 28 is connected to the discharge side of the compressor 1, and the indoor heat exchangers 5*c* to 5*e* are connected to a tail end. The other connection state is a connection state where the second pipe 28 is connected to the accumulator 4 provided at the suction side of the compressor 1, and the discharge side of the compressor 1 is connected to the tail end.

Here, the tail end indicates a portion that is not connected by a pipe, and the flow of refrigerant ends in the tail end. The flow switching device 2*a* and the flow rate adjustment device 2*b* are each illustrated as a four-way switching valve. The first outdoor heat exchanger 3*a* and the second outdoor heat exchanger 3*b* function as evaporators during heating operation, and function as condensers or radiators during cooling operation.

The first outdoor heat exchanger 3*a* is connected to the flow switching device 2*a*, and causes heat exchange to be performed between refrigerant and outdoor air. The second outdoor heat exchanger 3*b* is connected in parallel with the first outdoor heat exchanger 3*a* and the first flow rate control device 22, and causes heat exchange to be performed between the refrigerant and outdoor air. The first outdoor heat exchanger 3*a* and the second outdoor heat exchanger 3*b* cause heat exchange to be performed between air supplied from the outdoor flow rate control device 3*m* and the refrigerant, and evaporate and gasify the refrigerant, or condense and liquefy the refrigerant. The outdoor flow rate control device 3*m* defines a flow path of air flowing to the first outdoor heat exchanger 3*a* and the second outdoor heat exchanger 3*b*. The accumulator 4 is provided at the suction side of the compressor 1, and stores surplus refrigerant the amount of which corresponds to the difference between the amount of the refrigerant that flows during the heating operation mode and the amount of the refrigerant that flows during the cooling operation mode, or the amount of which corresponds to the difference between the amount of the refrigerant that flows after a transient change of the operation and the amount of the refrigerant that flows before the transient change of the operation. In the present Embodiment 1, the case where the two outdoor heat exchangers are connected in parallel is illustrated, but three or more outdoor heat exchangers may be connected in parallel.

The check valve 18 is connected to the second refrigerant pipe 7 between the first outdoor heat exchanger 3*a* and the second outdoor heat exchanger 3*b*, and the relay B, and allows refrigerant to flow in only a direction from the outdoor unit A to the relay B. The check valve 19 is provided in the first refrigerant pipe 6 between the relay B and the flow switching device 2*a*, and allows refrigerant to flow in only a direction from the relay B to the outdoor unit A. The check valve 20 is provided in the first connection pipe 60*a*, and causes the refrigerant discharged from the compressor 1 to circulate to the relay B during heating operation. The check valve 21 is provided in the second connection pipe 60*b*, and causes the refrigerant returning from the relay B to circulate to the suction side of the compressor 1 during heating operation.

The first connection pipe 60*a* connects, in the outdoor unit A, the first refrigerant pipe 6 between the flow switching device 2*a* and the check valve 19, and the second refrigerant pipe 7 between the check valve 18 and the relay B. The second connection pipe 60*b* connects, in the outdoor unit A, the first refrigerant pipe 6 between the check valve 19 and the relay B, and the second refrigerant pipe 7 between the first outdoor heat exchanger 3*a* and the check valve 18.

Further, in the outdoor unit A, a discharge pressure gauge 51, a suction pressure gauge 52, a medium pressure gauge 53, and a thermometer 54 are provided. The discharge pressure gauge 51 is provided at the discharge side of the compressor 1, and measures a pressure of the refrigerant discharged from the compressor 1. The suction pressure gauge 52 is provided at the suction side of the compressor 1, and measures the pressure of the refrigerant suctioned by the compressor 1. The medium pressure gauge 53 is provided at an upstream side of the check valve 18, and measures a medium pressure that is a pressure of the refrigerant at the upstream side of the check valve 18. The thermometer 54 is provided at the discharge side of the compressor 1, and measures a temperature of the refrigerant discharged from the compressor 1. Pressure information and temperature information detected by the discharge pressure gauge 51, the suction pressure gauge 52, the medium pressure gauge 53, and the thermometer 54 are sent to the controller 50 that controls the operation of the air-conditioning apparatus 100, and are used in control of respective actuators.

The first flow rate control device 22 is connected in series to the first outdoor heat exchanger 3*a*, is provided between the check valves 21 and 18 and the first outdoor heat exchanger 3*a*, and is configured such that it can be opened and closed. The first flow rate control device 22 adjusts a flow rate of the refrigerant flowing to the check valve 18 from the first outdoor heat exchanger 3*a* during cooling operation, and adjusts the flow rate of the refrigerant flowing into the first outdoor heat exchanger 3*a* from the check valve 21 during heating operation. Note that the first flow rate control device 22 is configured such that a flow path resistance continuously changes.

The second flow rate control device 24 is connected in series to the second outdoor heat exchanger 3*b*, is provided between the check valves 21 and 18 and the second outdoor heat exchanger 3*b*, and is configured such that it can be opened and closed. The second flow rate control device 24 adjusts a flow rate of the refrigerant flowing to the check valve 18 from the second outdoor heat exchanger 3*b* during cooling operation, and adjusts the flow rate of the refrigerant flowing into the second outdoor heat exchanger 3*b* from the check valve 21 during heating operation. The bypass pipe 25 bypasses the first outdoor heat exchanger 3*a* and the second outdoor heat exchanger 3*b*. The third flow rate control device 26 is provided in the middle of the bypass pipe 25, is configured such that it can be opened and closed, and controls the flow rate of the refrigerant flowing to the bypass pipe 25. The third flow rate control device 26 adjusts a flow rate of the refrigerant flowing into the first outdoor heat exchanger 3*a* and the second outdoor heat exchanger 3*b*. The second flow rate control device 24 and the third flow rate control device 26 are configured such that flow path resistances continuously change.

(Relay B)

The relay B contains a first branch section 10, a second branch section 11, a gas-liquid separation device 12, a first bypass pipe 14*a*, a second bypass pipe 14*b*, a fourth flow rate control device 13, a fifth flow rate control device 15, a first heat exchanger 17, a second heat exchanger 16 and a controller 50. Note that the controller 50 has same configuration and function as the controller 50 of the outdoor unit A.

The first branch section 10 branches the refrigerant flowing to the second refrigerant pipe 7 into the respective indoor units C to E. Further, the first branch section 10 causes the refrigerant flowing to each of the indoor units C to E to join and to flow into the first refrigerant pipe 6. The first branch section 10 includes solenoid valves 8*c* to 8*h* installed in the first indoor unit side refrigerant pipes 6*c* to 6*e* near the indoor unit. Each of the first indoor unit side refrigerant pipes 6*c* to 6*e* near the indoor unit is branched in the first branch section 10. One of the branched first indoor unit side refrigerant pipe 6*c* is connected to the first refrigerant pipe 6 via the solenoid valve 8*c*, and the other of the branched first indoor unit side refrigerant pipe 6*c* is connected to the second refrigerant pipe 7 via the solenoid valve 8*f*. One of the branched first indoor unit side refrigerant pipe 6*d* is connected to the first refrigerant pipe 6 via the solenoid valve 8*d*, and the other of the branched first indoor unit side refrigerant pipe 6*d* is connected to the second refrigerant pipe 7 via the solenoid valve 8*g*. One of the branched first indoor unit side refrigerant pipe 6*e* is connected to the first refrigerant pipe 6 via the solenoid valve 8*e*, and the other of the branched first indoor unit side refrigerant pipe 6*e* is connected to the second refrigerant pipe 7 via the solenoid valve 8*h*.

The solenoid valves 8*c* and 8*f*, of which the opening and closing are controlled, are switchably connected to the first indoor unit side refrigerant pipe 6*c* near the indoor unit C and the first refrigerant pipe 6, or to the first indoor unit side refrigerant pipe 6*c* near the indoor unit C and the second refrigerant pipe 7. The solenoid valves 8*d* and 8*g*, of which the opening and closing are controlled, are connected to the first indoor unit side refrigerant pipe 6*d* near the indoor unit D and the first refrigerant pipe 6, or to the first indoor unit side refrigerant pipe 6*d* near the indoor unit D and the second refrigerant pipe 7. The solenoid valve 8*e* and 8*h*, of which the opening and closing are controlled, are switchably connected to the first indoor unit side refrigerant pipe 6*e* near the indoor unit E and the first refrigerant pipe 6, or the first indoor unit side refrigerant pipe 6*e* near the indoor unit E and the second refrigerant pipe 7. The solenoid valves 8*c* and 8*f* installed in the first indoor unit side refrigerant pipe 6*c* near the indoor unit C are referred to as first solenoid valves. Further, the solenoid valves 8*d* and 8*g* installed in the first indoor unit side refrigerant pipe 6*d* near the indoor unit D are referred to as second solenoid valves. Further, solenoid valves 8*e* and 8*h* installed in the first indoor unit side refrigerant pipe 6*e* near the indoor unit E are referred to as third solenoid valves.

The second branch section 11 branches the refrigerant flowing to the first bypass pipe 14*a* into the respective indoor units C to E. Further, the second branch section 11 causes the refrigerant flowing to each of the indoor units C to E to join and to flow to the second bypass pipe 14*b*. The second branch section 11 has a joining portion of the first bypass pipe 14*a* and the second bypass pipe 14*b*. The gas-liquid separation device 12 is provided in the middle of the second refrigerant pipe 7, and separates the refrigerant flowing in via the second refrigerant pipe 7 into gas and a liquid. A gas phase component separated in the gas-liquid separation device 12 flows into the first branch section 10, and a liquid phase component separated in the gas-liquid separation device 12 flows into the second branch section 11.

The first bypass pipe 14*a* is a pipe connecting the gas-liquid separation device 12 and the second branch section 11 in the relay B. The second bypass pipe 14*b* is a pipe connecting the second branch section 11 and the first refrigerant pipe 6 in the relay B. The fourth flow rate control device 13 is provided in the middle of the first bypass pipe 14*a*, and is configured such that it can be opened and closed. The fifth flow rate control device 15 is provided in the middle of the second bypass pipe 14*b*, and is configured such that it can be opened and closed.

The first heat exchanger 17 causes heat exchange to be performed between the refrigerant that is present between the gas-liquid separation device 12 of the first bypass pipe 14*a* and the fourth flow rate control device 13, and the refrigerant that is present between the fifth flow rate control device 15 of the second bypass pipe 14*b* and the first refrigerant pipe 6. The second heat exchanger 16 causes heat exchange to be performed between the refrigerant between the fourth flow rate control device 13 of the first bypass pipe 14*a* and the second branch section 11, and the refrigerant between the fifth flow rate control device 15 of the second bypass pipe 14*b* and the first heat exchanger 17.

A flow switching valve such as a check valve may be provided in the second branch section 11, and the refrigerant flowing into the second branch section 11 from the indoor units C to E that perform heating is caused to flow into the second heat exchanger 16. In this case, the refrigerant before entering the fifth flow rate control device 15 reliably is turned to be liquid refrigerant of a single phase, and therefore, stable flow rate control can be performed.

(Indoor Units C to E)

The indoor units C to E are respectively installed at positions where the indoor units C to E can supply air for air-conditioning to air-conditioned spaces such as indoors, and supply cooling air or heating air to the air-conditioned spaces by cooling energy or heating energy from the outdoor unit A that are supplied via the relay B. The indoor units C to E respectively contain the indoor heat exchangers 5*c* to 5*e* and expansion sections 9*c* to 9*e*.

Further, in the vicinity of the indoor heat exchanger 5*c*, an indoor flow rate control device 5*cm* that controls a flow rate of indoor air that is a fluid that exchanges heat with the refrigerant is installed. In the vicinity of the indoor heat exchanger 5*d*, an indoor flow rate control device 5*dm* that controls a flow rate of indoor air that is a fluid that exchanges heat with the refrigerant is installed. In the vicinity of the indoor heat exchanger 5*e*, an indoor flow rate control device 5*em* that controls a flow rate of indoor air that is a fluid that exchanges heat with the refrigerant is installed. In the present Embodiment 1, an explanation is made by using air-cooled indoor heat exchangers as examples of the indoor heat exchangers 5*c* to 5*e*, and using indoor fans as examples of the indoor flow rate control devices 5*cm* to 5*em*, but the indoor heat exchangers 5*c* to 5*e* may be water-cooled indoor heat exchangers or other types as long as the indoor heat exchangers are each in a mode where the refrigerant exchanges heat with another fluid. In this case, as the indoor flow rate control devices 5*cm* to 5*em*, pumps are used.

The indoor heat exchanger 5*c* causes heat exchange to be performed between air supplied from the indoor flow rate control device 5*cm* and the refrigerant, the indoor heat exchanger 5*d* causes heat exchange to be performed between air supplied from the indoor flow rate control device 5*dm* and the refrigerant, and the indoor heat exchanger 5*e* causes heat exchange to be performed between air supplied from the indoor flow rate control device 5*em* and the refrigerant to generate heating air or cooling air to be supplied to the air-conditioned space. The indoor flow rate control devices 5*cm* to 5*em* respectively define wind paths of air flowing to the indoor heat exchangers 5*c* to 5*e*. The expansion sections 9*c* is provided between the second branch section 11 of the relay B and the indoor heat exchanger 5*c* and is configured such that it can be opened and closed. The expansion section 9*d* is provided between the second branch section 11 of the relay B, and the indoor heat exchanger 5*d*, and is configured such that it can be opened and closed. The expansion section 9*e* is provided between the second branch section 11 of the relay B and the indoor heat exchanger 5*e*, and is configured such that it can be opened and closed. The expansion sections 9*c* to 9*e* respectively control flow rates of the refrigerant flowing into the indoor heat exchangers 5*c* to 5*e*.

(Controller 50)

The air-conditioning apparatus 100 is provided with the controllers 50. The controllers 50 each control actuators and the like, based on refrigerant pressure information, refrigerant temperature information, outdoor temperature information, indoor temperature information and other kinds of information detected by respective sensors provided in the air-conditioning apparatus 100. For example, the controllers 50 each control drive of the compressor 1, switching of the flow switching device 2*a* and the flow rate adjustment device 2*b*, driving of a fan motor of the outdoor flow rate control device 3*m*, and driving of fan motors of the indoor flow rate control devices 5*cm* to 5*em*.

Further, the controllers 50 each control opening degrees of the first flow rate control device 22, the second flow rate control device 24, the third flow rate control device 26, the fourth flow rate control device 13 and the fifth flow rate control device 15. The controllers 50 each include a memory 50*a* in which functions and the like that determines respective control values are stored. Further, in the present Embodiment 1, a case where the controllers 50 are provided in the outdoor unit A and the relay B is illustrated, but the number of controllers 50 may be one, or three or more. Further, the controllers 50 may be installed in the indoor units C to E, or may be installed as separate units in other places than the outdoor unit A, the relay B and the indoor units C to E.

(Heat Exchange Amount Control Mode)

Next, a heat exchange amount control mode will be described. In a case of a low outside air cooling operation in which cooling is performed in a state where an outdoor temperature is low, heat exchange amounts of the first outdoor heat exchanger 3*a* and the second outdoor heat exchanger 3*b* can be small. The heat exchange amounts of the first outdoor heat exchanger 3*a* and the second outdoor heat exchanger 3*b* are controlled by the opening degrees of the first flow rate control device 22, the second flow rate control device 24 and the third flow rate control device 26. The mode in which the heat exchange amounts are controlled in this way is the heat exchange amount control mode.

For example, when the first flow rate control device 22 and the second flow rate control device 24 are fully opened, and the third flow rate control device 26 is fully closed, all of the refrigerant flows into the first outdoor heat exchanger 3*a* or the second outdoor heat exchanger 3*b*, and therefore the heat exchange amount is 100%. On the other hand, when the first flow rate control device 22 is fully opened, the second flow rate control device 24 is fully closed, and the third flow rate control device 26 is fully opened, the refrigerant generally flows evenly into the first pipe 27 and the bypass pipe 25, but does not flow into the second pipe 28. In other words, the heat exchange amount is 50%.

Figure 2:
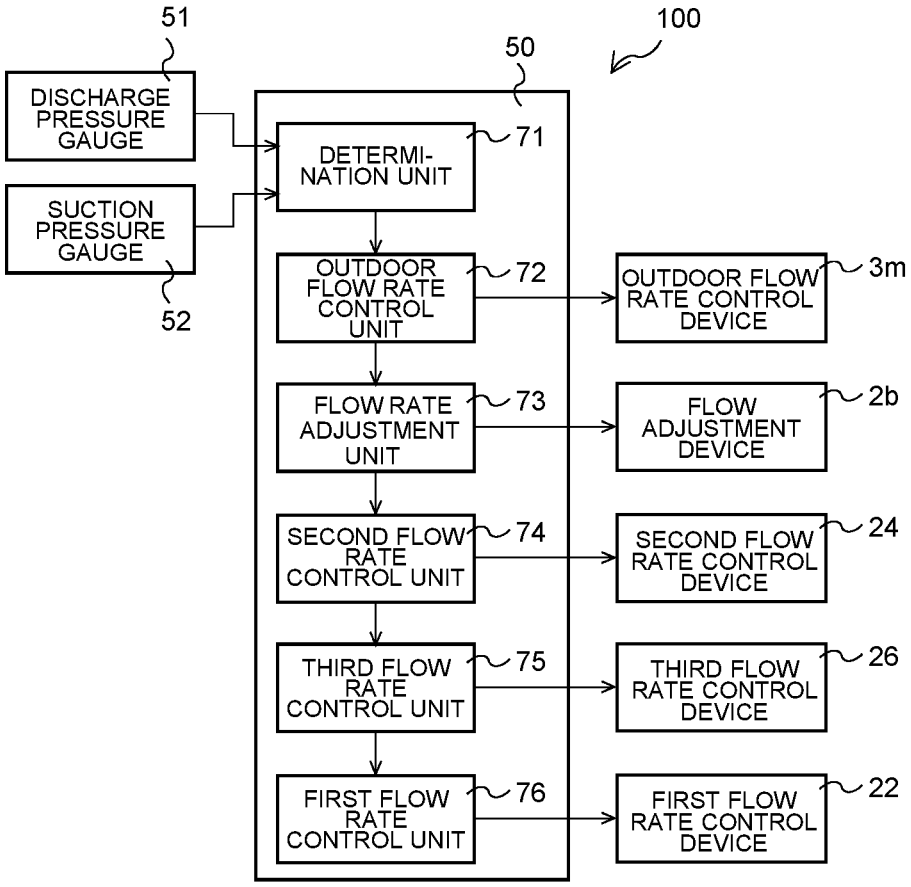
FIG. 2 is a functional block diagram illustrating a controller 50 in Embodiment 1 of the present disclosure.

FIG. 2 is a functional block diagram illustrating the controller 50 in Embodiment 1 of the present disclosure. As illustrated in FIG. 2, the controller 50 has a determination unit 71, an outdoor flow rate control unit 72, a flow rate adjustment unit 73, a second flow rate control unit 74, a third flow rate control unit 75, and a first flow rate control unit 76.

First, a case where a cooling operation or a cooling main operation is carried out will be described. The determination unit 71 determines whether a discharge pressure is lower than a discharge target value, when the cooling operation or the cooling main operation is carried out. Further, the determination unit 71 also has a function of determining whether a suction pressure of the refrigerant suctioned by the compressor 1 is higher than a suction target value. The outdoor flow rate control unit 72 determines whether a rotation speed of the outdoor flow rate control device 3*m* is a minimum rotation speed when the determination unit 71 determines that the discharge pressure is lower than the discharge target value, and reduces the rotation speed of the outdoor flow rate control device 3*m* when the rotation speed of the outdoor flow rate control device 3*m* is not the minimum rotation speed.

The flow rate adjustment unit 73 determines whether the flow rate adjustment device 2*b* connects the second outdoor heat exchanger 3*b* and the accumulator 4 on the suction side of the compressor 1 when the rotation speed of the outdoor flow rate control device 3*m* is the minimum rotation speed. When the flow rate adjustment device 2*b* does not connect the second outdoor heat exchanger 3*b* and the accumulator 4 on the suction side of the compressor 1, the flow rate adjustment unit 73 controls the flow rate adjustment device 2*b* to connect the second outdoor heat exchanger 3*b* and the accumulator 4 on the suction side of the compressor 1.

When the flow rate adjustment device 2*b* connects the second outdoor heat exchanger 3*b* and the accumulator 4 on the suction side of the compressor 1, the second flow rate control unit 74 determines whether the second flow rate control device 24 is fully closed. When the second flow rate control device 24 is not fully closed, the second flow rate control unit 74 decreases the opening degree of the second flow rate control device 24. When the second flow rate control device 24 is fully closed, the third flow rate control unit 75 determines whether the third flow rate control device 26 is fully opened, and when the third flow rate control device 26 is not fully opened, the third flow rate control unit 75 increases the opening degree of the third flow rate control device 26.

When the third flow rate control device 26 is fully opened, the first flow rate control unit 76 determines whether the first flow rate control device 22 has the minimum opening degree, and decreases the opening degree of the first flow rate control device 22 when the first flow rate control device 22 does not have the minimum opening degree. When the first flow rate control device 22 has the minimum opening degree, and the suction pressure is determined as the suction target value or less by the determination unit 71, the second flow rate control unit 74 intermittently controls the second flow rate control device 24 to open and close every preset time. On the other hand, when the suction pressure is higher than the suction target value, the controller 50 ends the heat exchange amount control mode.

When the discharge pressure is determined to be equal to or larger than the discharge target value by the determination unit 71, the outdoor flow rate control unit 72 determines whether the rotation speed of the outdoor flow rate control device 3*m* is a maximum rotation speed, and increases the rotation speed of the outdoor flow rate control device 3*m* when the rotation speed of the outdoor flow rate control device 3*m* is not the maximum rotation speed. The first flow rate control unit 76 determines whether the first flow rate control device 22 is fully opened when the rotation speed of the outdoor flow rate control device 3*m* is the maximum rotation speed, and increases the opening degree of the first flow rate control device 22 when the first flow rate control device 22 is not fully opened. When the first flow rate control device 22 is fully opened, the third flow rate control unit 75 determines whether the third flow rate control device 26 is fully closed, and decreases the opening degree of the third flow rate control device 26 when the third flow rate control device 26 is not fully closed.

When the third flow rate control device 26 is fully closed, the flow rate adjustment unit 73 determines whether the flow rate adjustment device 2*b* connects the second outdoor heat exchanger 3*b* and the discharge side of the compressor 1. When the flow rate adjustment device 2*b* does not connect the second outdoor heat exchanger 3*b* and the discharge side of the compressor 1, the flow rate adjustment unit 73 controls the flow rate adjustment device 2*b* to connect the second outdoor heat exchanger 3*b* and the discharge side of the compressor 1. On the other hand, when the flow rate adjustment device 2*b* connects the second outdoor heat exchanger 3*b* and the discharge side of the compressor 1, the controller 50 ends the heat exchange amount control mode.

Next, a case where a heating operation or a heating main operation is carried out will be described. When the heating operation or the heating main operation is carried out, the determination unit 71 determines whether the suction pressure is lower than the suction target value. When the determination unit 71 determines that the suction pressure is lower than the suction target value, the first flow rate control unit 76 and the second flow rate control unit 74 respectively determine whether the first flow rate control unit 76 and the second flow rate control unit 74 are fully opened. When the first flow rate control device 22 and the second flow rate control device 24 are not fully opened, the first flow rate control unit 76 increases the opening degree of the first flow rate control device 22. When the first flow rate control device 22 and the second flow rate control device 24 are not fully opened, the second flow rate control unit 74 increases the opening degree of the opening degree of the second flow rate control device 24.

When the first flow rate control device 22 and the second flow rate control device 24 are fully opened, the third flow rate control unit 75 determines whether the third flow rate control device 26 is fully closed, and when the third flow rate control device 26 is not fully closed, the third flow rate control unit 75 decreases the opening degree of the third flow rate control device 26. When the third flow rate control device 26 is fully closed, the outdoor flow rate control unit 72 determines whether the outdoor flow rate control device 3*m* is at a maximum rotation speed, and when the outdoor flow rate control device 3*m* is not at the maximum rotation speed, the outdoor flow rate control unit 72 increases the rotation speed of the outdoor flow rate control device 3*m*. On the other hand, when the outdoor flow rate control device 3*m* is at the maximum speed, the controller 50 ends the heat exchange amount control mode.

When the determination unit 71 determines that the suction pressure is the suction target value or more, the outdoor flow rate control unit 72 determines whether the rotation speed of the outdoor flow rate control device 3*m* is a minimum rotation speed, and when the rotation speed of the outdoor flow rate control device 3*m* is not the minimum rotation speed, the outdoor flow rate control unit 72 decreases the rotation speed of the outdoor flow rate control device 3*m*. When the rotation speed of the outdoor flow rate control device 3*m* is the minimum rotation speed, the third flow rate control unit 75 determines whether the third flow rate control device 26 is fully opened, and when the third flow rate control device 26 is not fully opened, the third flow rate control unit 75 increases the opening degree of the third flow rate control device 26. When the third flow rate control device 26 is fully opened, the first flow rate control unit 76 and the second flow rate control unit 74 respectively decrease the opening degree of the first flow rate control device 22 and the opening degree of the second flow rate control device 24 by predetermined amounts. Subsequently, the controller 50 ends the heat exchange amount control mode.

As mentioned above, the controller 50 switches the connection state to a connection state where in the flow rate adjustment device 2*b*, the second pipe 28 is connected to the suction side of the compressor 1 and the discharge side of the compressor 1 is connected to the tail end when performing a cooling operation. Thereby, the refrigerant discharged from the compressor 1 does not flow to the second outdoor heat exchanger 3*b*. Subsequently, the controller 50 controls the second flow rate control device 24 to close. As a result, the refrigerant flowing to the second outdoor heat exchanger 3*b* is prevented from flowing into the second refrigerant pipe 7. At this time, in the second outdoor heat exchanger 3*b*, low-pressure gaseous refrigerant flowing to the first refrigerant pipe 6 accumulates. The gaseous refrigerant has a density lower than that of liquid refrigerant. Therefore, a circulation amount of refrigerant necessary for operation hardly decreases. In this way, in the present Embodiment 1, the circulation amount of refrigerant necessary for operation can be secured even when the heat exchange amount is reduced.

(Operation Mode)

Next, action conducted by the air-conditioning apparatus 100 in various operation modes of the air-conditioning apparatus 100 will be described. The operations of the air-conditioning apparatus 100 include four modes of the cooling operation, the heating operation, the cooling main operation and the heating main operation.

The cooling operation is an operation mode in which all of the indoor units C to E perform the cooling operation or stop. The heating operation is an operation mode in which all of the indoor units C to E perform the heating operation or stop. The cooling main operation is an operation mode in which cooling or heating can be selected at each of the indoor units, and a cooling load is larger than a heating load. The cooling main operation is an operation mode in which the first outdoor heat exchanger 3*a* and the second outdoor heat exchanger 3*b* are connected to the discharge side of the compressor 1 and act as condensers or radiators. The heating main operation is an operation mode in which cooling or heating can be selected at each of the indoor units, and the heating load is larger than the cooling load. The heating main operation is an operation mode in which the first outdoor heat exchanger 3*a* and the second outdoor heat exchanger 3*b* are connected to the suction side of the compressor 1 and act as evaporators.

(Cooling Operation)

A case where all of the indoor units C, D and E are to perform cooling will be described. When the cooling operation is performed, the controller 50 switches the flow switching device 2*a* so that the refrigerant discharged from the compressor 1 flows to the first outdoor heat exchanger 3*a* and the second outdoor heat exchanger 3*b*. Further, the solenoid valves 8*c*, 8*d* and 8*e* respectively connected to the indoor units C, D and E are opened, and the solenoid valves 8*f*, 8*g* and 8*h* are closed.

In this state, an operation of the compressor 1 is started. Low-temperature and low-pressure gaseous refrigerant is compressed by the compressor 1 to be high-temperature and high-pressure gaseous refrigerant, and is discharged. The high-temperature and high-pressure gaseous refrigerant discharged from the compressor 1 flows into the first outdoor heat exchanger 3*a* and the second outdoor heat exchanger 3*b* via the flow switching device 2*a*. At this time, the refrigerant is cooled while heating the outdoor air, and is turned to be medium-temperature and high-pressure liquid refrigerant. The medium-temperature and high-pressure liquid refrigerant flowing out of the first outdoor heat exchanger 3*a* and the second outdoor heat exchanger 3*b* passes through the second refrigerant pipe 7 and is separated in the gas-liquid separation device 12. Subsequently, the separated refrigerant exchanges heat with the refrigerant flowing in the second bypass pipe 14*b*, in the first heat exchanger 17, thereafter passes through the fourth flow rate control device 13, exchanges, in the second heat exchanger 16, heat with the refrigerant flowing in the second bypass pipe 14*b*, and is cooled.

The liquid refrigerant cooled in the first heat exchanger 17 and the second heat exchanger 16 flows in the second branch section 11, a part of the liquid refrigerant is bypassed to the second bypass pipe 14*b*, and a remaining part flows into the second indoor unit side refrigerant pipes 7*c*, 7*d* and 7*e* near the indoor unit. The high-pressure liquid refrigerant branched in the second branch section 11 flows in the second indoor unit side refrigerant pipes 7*c*, 7*d* and 7*e* near the indoor unit, and flows into the expansion section 9*c* of the indoor unit C, the expansion section 9*d* of the indoor unit D and the expansion section 9*e* of the indoor unit E. The high-pressure liquid refrigerant is throttled in the expansion sections 9*c*, 9*d* and 9*e* to expand and is decompressed, and is brought into a low-temperature and low-pressure two-phase gas-liquid state. Change of the refrigerant in the expansion sections 9*c*, 9*d* and 9*e* is performed under a constant enthalpy. The refrigerant in the low-temperature and low-pressure two-phase gas-liquid state flowing out from the expansion sections 9*c*, 9*d* and 9*e* flows into the indoor heat exchangers 5*c*, 5*d* and 5*e*. The refrigerant is heated while cooling indoor air, and is turned to be low-temperature and low-pressure gaseous refrigerant.

The low-temperature and low-pressure gaseous refrigerant flowing out from the indoor heat exchanger 5*c* passes through the solenoid valve 8*c*, and flows into the first branch section 10. The low-temperature and low-pressure gaseous refrigerant flowing out from the indoor heat exchanger 5*d* passes through the solenoid valve 8*d*, and flows into the first branch section 10. The low-temperature and low-pressure gaseous refrigerant flowing out from the indoor heat exchanger 5*e* passes through the solenoid valve 8*e*, and flows into the first branch section 10. The low-temperature and low-pressure gaseous refrigerant joining in the first branch section 10 joins the low-temperature and low-pressure gaseous refrigerant heated in the first heat exchanger 17 and the second heat exchanger 16 of the second bypass pipe 14*b*, flows into the compressor 1 through the first refrigerant pipe 6 and the flow switching device 2*a* and is compressed.

When an outside temperature is low, and the discharge pressure of the refrigerant discharged from the compressor 1 is low, the controller 50 increases a differential pressure between the front and the back of the compressor 1. The controller 50 switches the flow rate adjustment device 2*b* to connect the second outdoor heat exchanger 3*b* and the accumulator 4, and closes the second flow rate control device 24, thereby decreasing a heat exchange volume. The controller 50 operates the third flow rate control device 26 bypassing the first outdoor heat exchanger 3*a* and the second outdoor heat exchanger 3*b* to change a flow rate of the refrigerant flowing into the first outdoor heat exchanger 3*a*, and controls the heat exchange amount of the first outdoor heat exchanger 3*a*. At this time, the controller 50 may control the heat exchange amount by decreasing the opening degree of the first flow rate control device 22, but a lower limit of the opening degree is such an opening degree that does not make the refrigerant stagnant.

Further, when the outside temperature is low, and the suction pressure of the refrigerant flowing into the compressor 1 is extremely low, the controller 50 increases the suction pressure of the compressor 1. The controller 50 switches the flow rate adjustment device 2*b* so as to connect the second outdoor heat exchanger 3*b* and the accumulator 4, and controls the second flow rate control device 24 intermittently. As a result, medium-pressure refrigerant discharged from the compressor 1 and passing through the first outdoor heat exchanger 3*a* and the first flow rate control device 22 is bypassed to a low-pressure circuit, and the suction pressure of the refrigerant flowing into the compressor 1 can also be enhanced.

(Heating Operation)

A case where all of the indoor units C, D, and E are to perform heating will be described. When the heating operation is performed, the controller 50 switches the flow switching device 2*a* so that the refrigerant discharged from the compressor 1 flows into the first branch section 10. Further, the solenoid valves 8*c*, 8*d* and 8*e* connected to the indoor units C, D and E are closed, and the solenoid valves 8*f*, 8*g* and 8*h* are opened.

In this state, an operation of the compressor 1 is started. Low-temperature and low-pressure gaseous refrigerant is compressed by the compressor 1, is turned to be high-temperature and high-pressure gaseous refrigerant and is discharged. The high-temperature and high-pressure gaseous refrigerant discharged from the compressor 1 flows into the first branch section 10 via the flow switching device 2*a* and the second refrigerant pipe 7. The high-temperature and high-pressure gaseous refrigerant flowing into the first branch section 10 is branched in the first branch section 10, passes through the solenoid valves 8*f*, 8*g* and 8*h*, and flows into the indoor heat exchangers 5*c*, 5*d* and 5*e*. The refrigerant is heated while cooling indoor air, and is turned to be medium-temperature and high-pressure liquid refrigerant.

The medium-temperature and high-pressure liquid refrigerant flowing out from the indoor heat exchangers 5*c*, 5*d* and 5*e* flows into the expansion sections 9*c*, 9*d* and 9*e*, joins in the second branch section 11, and flows into the fifth flow rate control device 15. The high-pressure liquid refrigerant is throttled in the expansion sections 9*c*, 9*d* and 9*e*, the fifth flow rate control device 15, the first flow rate control device 22 and the second flow rate control device 24, expanded and decompressed, and is brought into a low-temperature and low-pressure two-phase gas-liquid state.

The refrigerant in the low-temperature and low-pressure two-phase gas-liquid state that flows out from the first flow rate control device 22 and the second flow rate control device 24 flows into the first outdoor heat exchanger 3*a* and the second outdoor heat exchanger 3*b*, the refrigerant is heated while cooling outdoor air, and is turned to be low-temperature and low-pressure gaseous refrigerant. The low-temperature and low-pressure gaseous refrigerant flowing out from the first outdoor heat exchanger 3*a* and the second outdoor heat exchanger 3*b* passes through the flow switching device 2*a*, flows into the compressor 1, and is compressed.

When the outside temperature is high, and suction pressure of the refrigerant suctioned by the compressor 1 increases, the controller 50 operates the third flow rate control device 26 that bypasses the first outdoor heat exchanger 3*a* and the second outdoor heat exchanger 3*b* to increase the differential pressure across the compressor 1. As a result, the controller 50 changes the flow rate of the refrigerant flowing into the first outdoor heat exchanger 3*a* and the second outdoor heat exchanger 3*b*, and controls the heat exchange amount of the first outdoor heat exchanger 3*a* and the second outdoor heat exchanger 3*b*.

(Cooling Main Operation)

A case where the indoor units C and D perform cooling, and the indoor unit E performs heating will be described. In this case, the controller 50 switches the flow switching device 2*a* so that the refrigerant discharged from the compressor 1 flows into the first outdoor heat exchanger 3*a* and the second outdoor heat exchanger 3*b*. Further, the solenoid valve 8*c* connected to the indoor unit C, the solenoid valve 8*d* connected to the indoor unit D and the solenoid valve 8*h* connected to the indoor unit E are opened, and the solenoid valves 8*f*, 8*g* and 8*e* are closed.

In this state, an operation of the compressor 1 is started. Low-temperature and low-pressure gaseous refrigerant is compressed by the compressor 1 to be high-temperature and high-pressure gaseous refrigerant, and is discharged. The high-temperature and high-pressure gaseous refrigerant discharged from the compressor 1 flows into the first outdoor heat exchanger 3*a* and the second outdoor heat exchanger 3*b* via the flow switching device 2*a*. At this time, in the first outdoor heat exchanger 3*a* and the second outdoor heat exchanger 3*b*, the refrigerant is cooled while heating outdoor air with a heat amount necessary for heating being left, and is brought into a medium-temperature and high-pressure two-phase gas-liquid state.

The medium-temperature and high-pressure two-phase gas-liquid refrigerant flowing out from the first outdoor heat exchanger 3*a* and the second outdoor heat exchanger 3*b* passes through the second refrigerant pipe 7 and flows into the gas-liquid separation device 12. In the gas-liquid separation device 12, the medium-temperature and high-pressure two-phase gas-liquid refrigerant is separated into gaseous refrigerant and liquid refrigerant. The gaseous refrigerant separated in the gas-liquid separation device 12 flows into the indoor heat exchanger 5*e* that performs heating via the first branch section 10 and the solenoid valve 8*h*. The refrigerant is cooled while heating the indoor air, and is turned to be medium-temperature and high-pressure liquid refrigerant. On the other hand, the liquid refrigerant separated in the gas-liquid separation device 12 flows into the first heat exchanger 17, exchanges heat with low-pressure refrigerant flowing in the second bypass pipe 14*b* and is cooled.

The refrigerant flowing out from the indoor heat exchanger 5*e* that performs heating passes through the expansion section 9*e*, and the refrigerant flowing out from the first heat exchanger 17 passes through the fourth flow rate control device 13 and the second heat exchanger 16, and join each other in the second branch section 11. Part of the joined liquid refrigerant is bypassed by the second bypass pipe 14*b*, and a remaining part flows into the expansion sections 9*c* and 9*d* provided respectively in the indoor units C and D that perform cooling. The high-pressure liquid refrigerant is throttled to be expanded and decompressed in the expansion sections 9*c* and 9*d*, and is brought into a low-temperature and low-pressure two-phase gas-liquid state. Change of the refrigerant in the expansion sections 9*c* and 9*d* is performed under constant enthalpy.

The refrigerant in the low-temperature and low-pressure two-phase gas-liquid state that flows out from the expansion sections 9*c* and 9*d* flows into the indoor heat exchangers 5*c* and 5*d* that perform cooling. The refrigerant is heated while cooling indoor air, and is turned to be low-temperature and low-pressure gaseous refrigerant. The low-temperature and low-pressure gaseous refrigerant flowing out from the indoor heat exchangers 5*c* and 5*d* respectively passes through the solenoid valves 8*c* and 8*d* and flows into the first branch section 10. The low-temperature and low-pressure gaseous refrigerant that has joined in the first branch section 10 joins the low-temperature and low-pressure gaseous refrigerant heated in the first heat exchanger 17 and the second heat exchanger 16 of the second bypass pipe 14*b*, flows into the compressor 1 through the first refrigerant pipe 6 and the flow switching device 2*a* and is compressed.

When an outside temperature is low, and the discharge pressure of the refrigerant discharged from the compressor 1 is low, the controller 50 increases the differential pressure between the front and the back of the compressor 1. The controller 50 switches the flow rate adjustment device 2*b* to connect the second outdoor heat exchanger 3*b* to the accumulator 4, and closes the second flow rate control device 24, thereby decreasing a heat exchange volume. The controller 50 operates the third flow rate control device 26 bypassing the first outdoor heat exchanger 3*a* and the second outdoor heat exchanger 3*b* to change a flow rate of the refrigerant flowing into the first outdoor heat exchanger 3*a* and the second outdoor heat exchanger 3*b*. As a result, the controller 50 controls the heat exchange amount of the first outdoor heat exchanger 3*a* and the second outdoor heat exchanger 3*b*. At this time, the controller 50 may control the heat exchange amount by decreasing the opening degree of the first flow rate control device 22, but a lower limit of the opening degree is such an opening degree that does not cause the refrigerant to stagnate.

(Heating Main Operation)

A case where the indoor unit C performs cooling, and the indoor units D and E perform heating will be described. In this case, the controller 50 switches the flow switching device 2*a* so that the refrigerant discharged from the compressor 1 flows into the first branch section 10. Further, the solenoid valve 8*f* connected to the indoor unit C, the solenoid valve 8*d* connected to the indoor unit D and the solenoid valve 8*e* connected to the indoor unit E are closed, and the solenoid valves 8*c*, 8*g* and 8*h* are opened. Further, in order to reduce a pressure difference between the indoor unit C that performs cooling, and the first outdoor heat exchanger 3*a* and the second outdoor heat exchanger 3*b*, the first flow rate control device 22 is controlled to be fully opened or to make an evaporation pressure of the second refrigerant pipe 7 approximately 0 degrees C. when converted in saturated temperature.

In this state, an operation of the compressor 1 is started. Low-temperature and low-pressure gaseous refrigerant is compressed by the compressor 1 to be high-temperature and high-pressure gaseous refrigerant and is discharged. The high-temperature and high-pressure gaseous refrigerant discharged from the compressor 1 flows into the first branch section 10 via the flow switching device 2*a* and the second refrigerant pipe 7. The high-temperature and high-pressure gaseous refrigerant flowing into the first branch section 10 is branched in the first branch section 10, and passes through the solenoid valves 8*g* and 8*h* to flow into the indoor heat exchangers 5*d* and 5*e* of the indoor units D and E that perform heating. The refrigerant is cooled while heating indoor air, and is turned to be medium-temperature and high-pressure liquid refrigerant.

The medium-temperature and high-pressure liquid refrigerant flowing out from the indoor heat exchangers 5*d* and 5*e* flows into the expansion sections 9*d* and 9*e*, and joins in the second branch section 11. A part of the high-pressure liquid refrigerant joining in the second branch section 11 flows into the expansion section 9*c* connected to the indoor unit C that performs cooling. The high-pressure liquid refrigerant is throttled, expanded and decompressed in the expansion section 9*c*, and is brought into a low-temperature and low-pressure two-phase gas-liquid state.

The refrigerant in the low-temperature and low-pressure two-phase gas-liquid state flowing out from the expansion section 9*c* flows into the indoor heat exchanger 5*c* that perform cooling. The refrigerant is heated while cooling the indoor air, and is turned to be low-temperature and low-pressure gaseous refrigerant. The low-temperature and low-pressure gaseous refrigerant flowing out from the indoor heat exchanger 5*c* passes through the solenoid valve 8*c* and flows into the first refrigerant pipe 6. A remaining part of the high-pressure liquid refrigerant flowing into the second branch section 11 from the indoor heat exchangers 5*d* and 5*e* that perform heating flows into the fifth flow rate control device 15. The high-pressure liquid refrigerant is throttled, expanded and decompressed in the fifth flow rate control device 15, and is brought into a low-temperature and low-pressure two-phase gas-liquid state. The refrigerant in the low-temperature and low-pressure two-phase gas-liquid state flowing out from the fifth flow rate control device 15 flows into the first refrigerant pipe 6, and joins the low-temperature and low-pressure gaseous refrigerant flowing in from the indoor heat exchanger 5*c* that performs cooling.

The refrigerant in the low-temperature and low-pressure two-phase gas-liquid state that joins in the first refrigerant pipe 6 flows into the first outdoor heat exchanger 3*a* and the second outdoor heat exchanger 3*b*. The refrigerant receives heat from outdoor air, and is turned to be low-temperature and low-pressure gaseous refrigerant. The low-temperature and low-pressure gaseous refrigerant flowing out from the first outdoor heat exchanger 3*a* and the second outdoor heat exchanger 3*b* flows into the compressor 1 through the flow switching device 2*a*, and is compressed.

(Operation of Controller 50)

Figure 3:
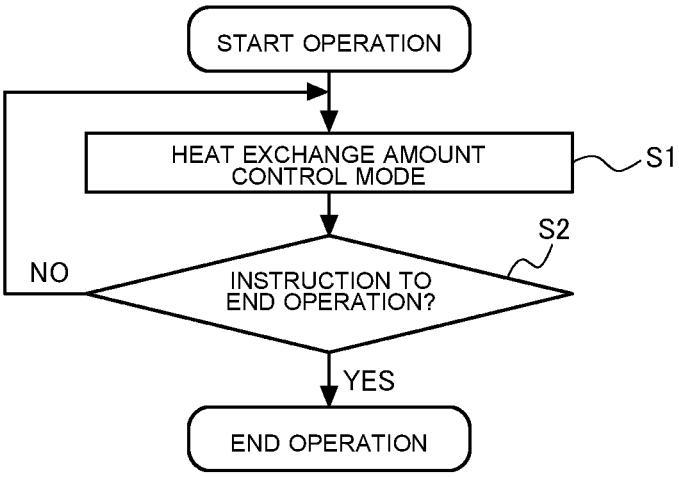
FIG. 3 is a flowchart illustrating operation of the air-conditioning apparatus 100 according to Embodiment 1 of the present disclosure.

FIG. 3 is a flowchart illustrating operation of the air-conditioning apparatus 100 according to Embodiment 1 of the present disclosure. Next, the operation of the air-conditioning apparatus 100 will be described. As illustrated in FIG. 3, when the operation of the air-conditioning apparatus 100 is started, a heat exchange amount control mode in the first outdoor heat exchanger 3*a* and the second outdoor heat exchanger 3*b* is executed (step S1). After the air-conditioning apparatus 100 is operated in the heat exchange amount control mode, it is determined whether an instruction to end the operation is received (step S2). When the instruction to end the operation is not received, step S1 is repeated, and when the instruction to end the operation is received, the operation of the air-conditioning apparatus 100 is ended.

Figure 4:
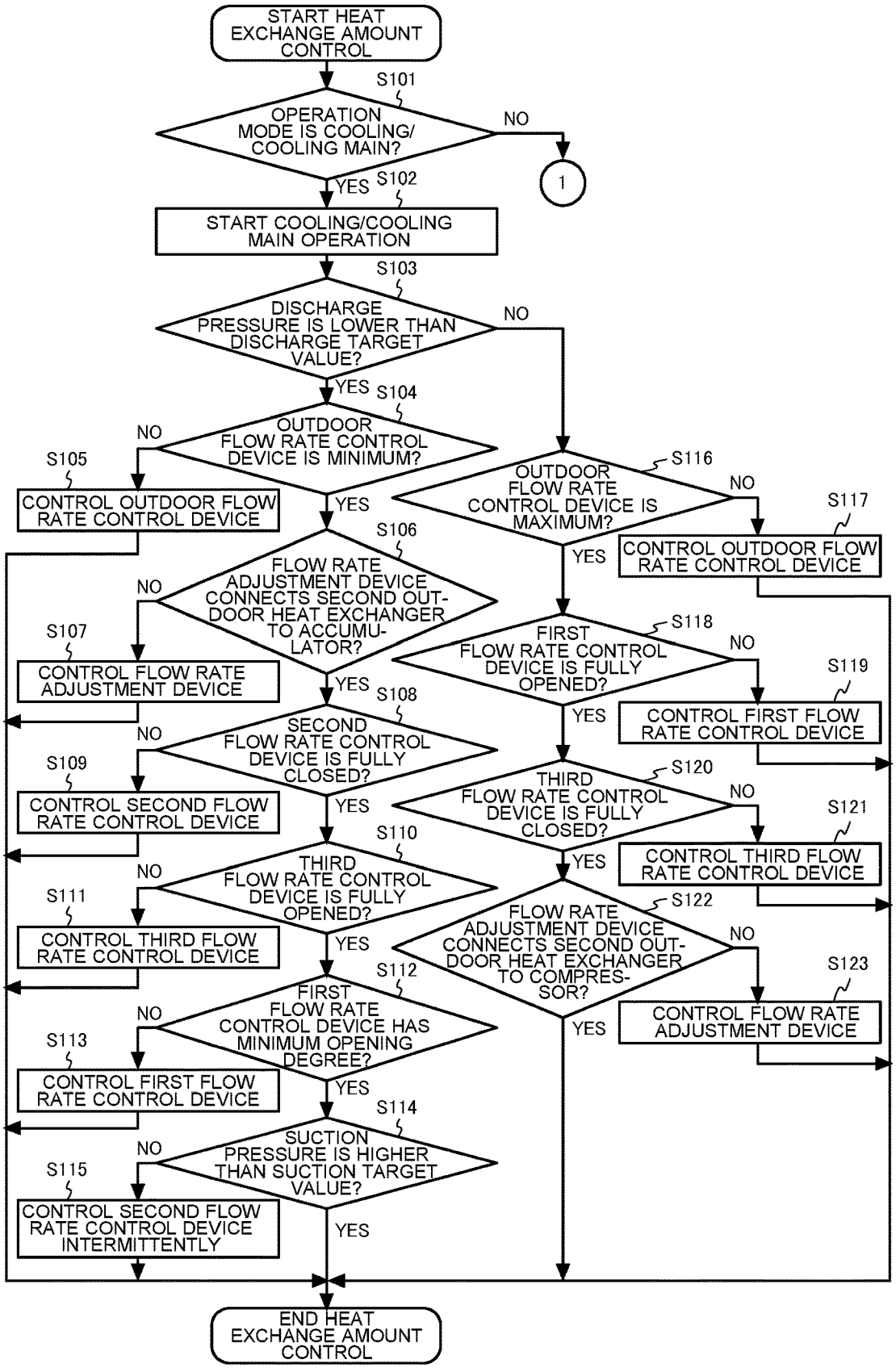
FIG. 4 is a flowchart illustrating a heat exchange amount control mode of the air-conditioning apparatus 100 according to Embodiment 1 of the present disclosure.
Figure 5:
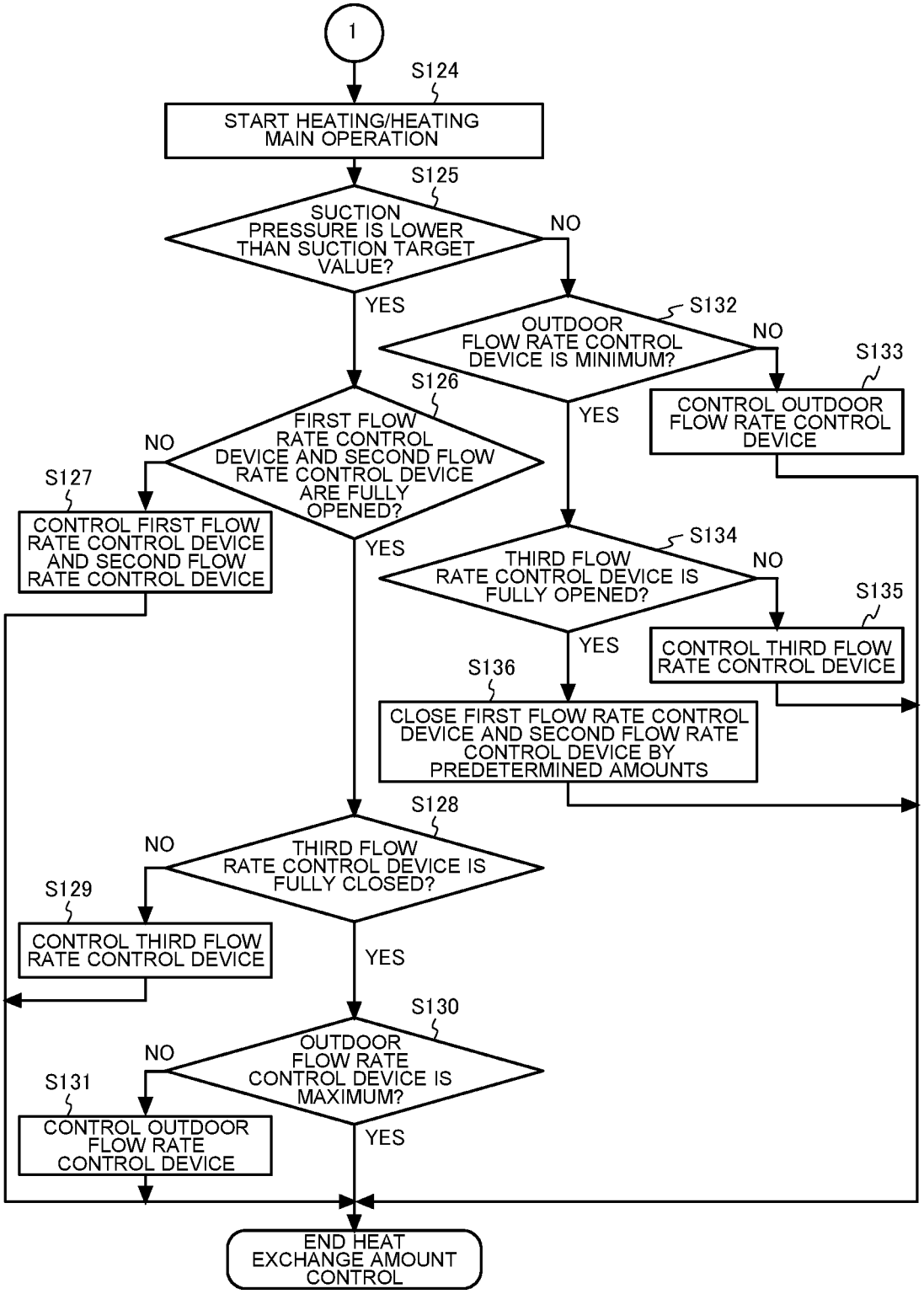
FIG. 5 is a flowchart illustrating a heat exchange amount control mode of the air-conditioning apparatus 100 according to Embodiment 1 of the present disclosure.

FIG. 4 and FIG. 5 are flowcharts illustrating the heat exchange amount control modes of the air-conditioning apparatus 100 according to Embodiment 1 of the present disclosure. Next, the gist of control of step S1 in FIG. 3 will be described in detail. As illustrated in FIG. 4, when the heat exchange amount control is started, it is determined whether the operation mode is a cooling operation or a cooling main operation (step S101). When the cooling operation or the cooling main operation is carried out (step S102), the controller 50 determines whether the discharge pressure is lower than a discharge target value (step S103). When the discharge pressure is the discharge target value or more (No in step S103), the controller 50 further determines whether the rotation speed of the outdoor flow rate control device 3*m* is the maximum rotation speed (step S116).

When the rotation speed of the outdoor flow rate control device 3*m* is not the maximum rotation speed (No in step S116), the controller 50 increases the rotation speed of the outdoor flow rate control device 3*m* (step S117). On the other hand, when the rotation speed of the outdoor flow rate control device 3*m* is the maximum rotation speed (Yes in step S116), the controller 50 determines whether the first flow rate control device 22 is fully opened (step S118). When the first flow rate control device 22 is not fully opened (No in step S118), the controller 50 increases the opening degree of the first flow rate control device 22 (step S119). When the first flow rate control device 22 is fully opened on the other hand (Yes in step S118), the controller 50 determines whether the third flow rate control device 26 is fully closed (step S120).

When the third flow rate control device 26 is not fully closed (No in step S120), the controller 50 decreases the opening degree of the third flow rate control device 26 (step S121). When the third flow rate control device 26 is fully closed (Yes in step S120) on the other hand, the controller 50 determines whether the flow rate adjustment device 2*b* connects the second outdoor heat exchanger 3*b* to the discharge side of the compressor 1 (step S122). When the flow rate adjustment device 2*b* does not connect the second outdoor heat exchanger 3*b* to the discharge side of the compressor 1 (No in step S122), the controller 50 controls the connection state of the flow rate adjustment device 2*b*. Specifically, the controller 50 controls the flow rate adjustment device 2*b* to connect the second outdoor heat exchanger 3*b* to the discharge side of the compressor 1 (step S123). When the flow rate adjustment device 2*b* connects the second outdoor heat exchanger 3*b* to the discharge side of the compressor 1 (Yes in step S122), the controller 50 ends the heat exchange amount control mode.

Here, when the discharge pressure is lower than the discharge target value (Yes in step S103), the controller 50 further determines whether the rotation speed of the outdoor flow rate control device 3*m* is the minimum rotation speed (step S104). When the rotation speed of the outdoor flow rate control device 3*m* is not the minimum rotation speed (No in step S104), the controller 50 decreases the rotation speed of the outdoor flow rate control device 3*m* (step S105). When the rotation speed of the outdoor flow rate control device 3*m* is the minimum rotation speed (Yes in step S104) on the other hand, the controller 50 determines whether the flow rate adjustment device 2*b* connects the second outdoor heat exchanger 3*b* to the accumulator 4 on the suction side of the compressor 1 (step S106).

When the flow rate adjustment device 2*b* does not connect the second outdoor heat exchanger 3*b* to the accumulator 4 on the suction side of the compressor 1 (No in step S106), the controller 50 controls the connection state of the flow rate adjustment device 2*b*. Specifically, the controller 50 controls the flow rate adjustment device 2*b* so as to connect the second outdoor heat exchanger 3*b* to the accumulator 4 on the suction side of the compressor 1 (step S107). On the other hand, when the flow rate adjustment device 2*b* connects the second outdoor heat exchanger 3*b* to the accumulator 4 on the suction side of the compressor 1 (Yes in step S106), the controller 50 determines whether the second flow rate control device 24 is fully closed (step S108). When the second flow rate control device 24 is not fully closed (No in step S108), the controller 50 decreases the opening degree of the second flow rate control device 24 (step S109). On the other hand, when the second flow rate control device 24 is fully closed (Yes in step S108), the controller 50 determines whether the third flow rate control device 26 is fully opened (step S110).

When the third flow rate control device 26 is not fully opened (No in step S110), the controller 50 increases the opening degree of the third flow rate control device 26 (step S111). On the other hand, when the third flow rate control device 26 is fully opened (Yes in step S110), the controller 50 determines whether the first flow rate control device 22 has a minimum opening degree (step S112). When the first flow rate control device 22 does not has the minimum opening degree (No in step S112), the controller 50 decreases the opening degree of the first flow rate control device 22 (step S113). On the other hand, when the first flow rate control device 22 has the minimum opening degree (Yes in step S112), the controller 50 determines whether the suction pressure is higher than the suction target value (step S114). When the suction pressure is the suction target value or less (No in step S114), the controller 50 intermittently controls the second flow rate control device 24 (step S115). On the other hand, when the suction pressure is higher than the suction target value (Yes in step S114), the controller 50 ends the heat exchange amount control mode.

In step S103 to step S115 and step S116 to step S123 in FIG. 4, the priority of the actuator when the control values of the respective actuator is fixed. The controller 50 changes the control value of each of the actuators by multiplying a difference between a discharge target value of the discharge pressure that is set and a detection value by a gain. Further, two or more actuators may be simultaneously controlled.

As illustrated in FIG. 5, when the heating operation or the heating main operation is carried out (step S124), the controller 50 determines whether the suction pressure is lower than the suction target value (step S125). When the suction pressure is the suction target value or more (No in step S125), the controller 50 further determines whether the rotation speed of the outdoor flow rate control device 3*m* is the minimum rotation speed (step S132). When the rotation speed of the outdoor flow rate control device 3*m* is not the minimum rotation speed (No in step S132), the controller 50 decreases the rotation speed of the outdoor flow rate control device 3*m* (step S133). On the other hand, when the rotation speed of the outdoor flow rate control device 3*m* is the minimum rotation speed (Yes in step S132), the controller 50 determines whether the third flow rate control device 26 is fully opened (step S134).

When the third flow rate control device 26 is not fully opened (No in step S134), the controller 50 increases the opening degree of the third flow rate control device 26 (step S135). On the other hand, when the third flow rate control device 26 is fully opened (Yes in step S134), the controller 50 decreases the opening degree of the first flow rate control device 22 and the opening degree of the second flow rate control device 24 by predetermined amounts (step S136). Subsequently, the controller 50 ends the heat exchange amount control mode.

Here, when the suction pressure is lower than the suction target value (Yes in step S125), the controller 50 determines whether the first flow rate control device 22 and the second flow rate control device 24 are fully opened (step S126). When the first flow rate control device 22 and the second flow rate control device 24 are not fully opened (No in step S126), the controller 50 increases the opening degree of the first flow rate control device 22 and the opening degree of the second flow rate control device 24 (step S127). When the first flow rate control device 22 and the second flow rate control device 24 are fully opened (Yes in step S126), the controller 50 determines whether the third flow rate control device 26 is fully closed (step S128).

When the third flow rate control device 26 is not fully closed (No in step S128), the controller 50 decreases the opening degree of the third flow rate control device 26 (step S129). When the third flow rate control device 26 is fully closed (Yes in step S128), the controller 50 determines whether the outdoor flow rate control device 3*m* is at the maximum rotation speed (step S130). When the outdoor flow rate control device 3*m* is not at the maximum rotation speed (No in step S130), the controller 50 increases the rotation speed of the outdoor flow rate control device 3*m* (step S131). On the other hand, when the outdoor flow rate control device 3*m* is at the maximum rotation speed (Yes in step S130), the controller 50 ends the heat exchange amount control mode.

In step S125 to step S131 and step S132 to step S136 in FIG. 5, the priority of actuator when the control values of the respective actuator is fixed. The controller 50 changes the control value of each of the actuators by multiplying a difference between a discharge target value of the discharge pressure that is set and a detection value by a gain. Further, two or more actuators may be simultaneously controlled. For example, at the same time as the second flow rate control device 24 is closed, the third flow rate control device 26 may be opened. As a result, even when the second flow rate control device 24 is closed and the refrigerant does not flow to the second refrigerant pipe 7 from the second pipe 28, the third flow rate control device 26 is opened and a corresponding amount of refrigerant flows to the bypass pipe 25, and the refrigerant flows to the second refrigerant pipe 7 from the bypass pipe 25. Accordingly, the amount of the refrigerant circulating in the entire air-conditioning apparatus 100 can be maintained.

According to the present Embodiment 1, in order to decrease the heat exchange amount of the first outdoor heat exchanger 3*a* and the second outdoor heat exchanger 3*b*, the first flow rate control device 22, the second flow rate control device 24 and the flow rate adjustment device 2*b* are controlled. As a result, even when the amount of the refrigerant flowing out from the second outdoor heat exchanger 3*b* decreases, the amount of the refrigerant can be made up by increasing the amount of the refrigerant flowing to the bypass pipe 25. Further, a low-pressure gaseous refrigerant having a density lower than that of the liquid refrigerant accumulates in the second outdoor heat exchanger 3*b*. Thereby, condensation areas of the first outdoor heat exchanger 3*a* and the second outdoor heat exchanger 3*b* that act as the condensers during cooling operation are reduced, and the heat exchange amounts can be decreased. Accordingly, even when the heat exchange amount is decreased, the circulation amount of the refrigerant that is necessary for operation can be secured.

Further, until now, when the cooling operation is switched to the heating operation by the flow switching device, in the state where the refrigerant accumulates in the outdoor heat exchanger, the liquid refrigerant that accumulates in the outdoor heat exchanger flows to the accumulator provided on the suction side of the compressor 1. When the liquid refrigerant with a volume of the accumulator or more flows in, there is a possibility that "liquid back" that the liquid refrigerant flows to the suction side of the compressor occurs, and the compressor may be broken down. In relation to this, in the present Embodiment 1, the refrigerant does not accumulate in the first outdoor heat exchanger 3*a* and the second outdoor heat exchanger 3*b* when the heat exchange amount control is performed, and therefore the "liquid back" does not occur. In this way, in the present Embodiment 1, "liquid back" can also be restrained. Further, the air-conditioning apparatus in which heat exchange amount control of the outdoor heat exchanger is performed has hitherto been known. As such air-conditioning apparatus, an air-conditioning apparatus is known that realizes a cooling and heating mixed operation of performing a cooling operation and a heating operation simultaneously, with a plurality of indoor units being connected to one or a plurality of outdoor units. In the present Embodiment 1, in such air-conditioning apparatus capable of performing the cooling and heating mixed operation, the circulation amount of the refrigerant necessary for operation can be secured even when the heat exchange amount is decreased.

Further, as in step S114 and step S115 in FIG. 4, the controller 50 intermittently controls the second flow rate control device 24 when the low pressure is a threshold or less. As a result, even when the cooling operation or the cooling main operation is performed when the outdoor air temperature is low, the low pressure can be restrained from being excessively reduced.

REFERENCE SIGNS LIST

1 compressor, 2*a* flow switching device, 2*b* flow control device, 3 outdoor heat exchange unit 3*a* first outdoor heat exchanger, 3*b* second outdoor heat exchanger, 3*m* outdoor flow rate control device, 4 accumulator, 5*c*, 5*d*, 5*e* indoor heat exchanger, 5*cm*, 5*dm*, 5*em* indoor flow rate control device,

6 first refrigerant pipe, 6*c*, 6*d*, 6*e* first indoor unit side refrigerant pipe, 7 second refrigerant pipe, 7*c*, 7*d*, 7*e* second indoor unit side refrigerant pipe, 8*c*, 8*d*, 8*e*, 8*f*, 8*g* 8*h* solenoid valve, 9*c*, 9*d*, 9*e* expansion section, 10 first branch section, 11 second branch section, 12 gas-liquid separation device, 13 fourth flow rate control device, 14*a* first bypass pipe, 14*b* second bypass pipe,

15 fifth flow rate control device, 16 second heat exchanger, 17 first heat exchanger, 18 check valve, 19 check valve, 20 check valve, 21 check valve, 22 first flow rate control device, 24 second flow rate control device, 25 bypass pipe, 26 third flow rate control device, 27 first pipe, 28 second pipe,

50 controller, 50*a* memory, 51 discharge pressure gauge, 52 suction pressure gauge, 53 middle pressure gauge, 54 thermometer, 60*a* first connection pipe, 60*b* second connection pipe, 71 determination unit, 72 outdoor flow rate control unit, 73 flow rate adjustment unit, 74 second flow rate control unit, 75 third flow rate control unit, 76 first flow rate control unit, 100 air-conditioning apparatus, A outdoor unit, B relay, C, D, E indoor unit

The invention claimed is:

1. An air-conditioning apparatus comprising:

a compressor, a flow switching valve, an outdoor heat exchange unit, an expansion section and an indoor heat exchanger, which are connected by pipes, wherein the outdoor heat exchange unit includes a first outdoor heat exchanger connected to the flow switching valve, a first flow rate control device connected in series to the first outdoor heat exchanger, a second outdoor heat exchanger connected in parallel with the first outdoor heat exchanger and the first flow rate control device, a second flow rate control device connected in series to the second outdoor heat exchanger, a bypass pipe connected to a branch point between the flow switching valve and the first heat exchanger, and a branch point between the first flow rate control device and the second flow rate control device, and the expansion section, and is configured to bypass the first outdoor heat exchanger and the first flow rate control device, and the second outdoor heat exchanger and the second flow rate control device, a third flow rate control device provided in the bypass pipe, and a flow rate adjustment valve connected between a discharge side of the compressor and the second outdoor heat exchanger; and a controller configured to control operation of the flow rate adjustment valve, the controller is configured to switch a connection state where in the flow rate adjustment valve, the second outdoor heat exchanger is connected to an accumulator provided at a suction side of the compressor and a discharge side of the compressor is connected to a tail end of the pipes where refrigerant flow therethrough terminates, and control the second flow rate control device to close, when performing a cooling operation.

2. The air-conditioning apparatus of claim 1, wherein the controller further determines whether discharge pressure of refrigerant discharged from the compressor is lower than a discharge target value during cooling operation, and controls the flow rate adjustment valve to restrain refrigerant from flowing to the second outdoor heat exchanger when the discharge pressure detected by a discharge pressure gauge is lower than the discharge target value.

3. The air-conditioning apparatus of claim 1, wherein the controller further controls the second flow rate control device to close when the discharge pressure detected by a discharge pressure gauge is lower than a discharge target value during cooling operation.

4. The air-conditioning apparatus of claim 2, further comprising an outdoor flow rate control fan configured to form a flow path of air flowing to the first outdoor heat exchanger and the second outdoor heat exchanger, wherein the controller further controls the outdoor flow rate control fan to decrease a rotation speed of the outdoor flow rate control fan when the discharge pressure detected by the discharge pressure gauge is lower than the discharge target value.

5. The air-conditioning apparatus of claim 1, wherein the controller further determines whether the suction pressure of refrigerant suctioned by the compressor is higher than the suction target value, and controls the second flow rate control device to open and close intermittently, when the suction pressure detected by a suction pressure gauge is the suction target value or less.

6. The air-conditioning apparatus of claim 1, wherein the flow rate adjustment valve switches a connection state in which the second outdoor heat exchanger is connected to the discharge side of the compressor, and a connection state in which the second outdoor heat exchanger is connected to the suction side of the compressor.

7. The air-conditioning apparatus of claim 1, wherein in the second flow rate control device a flow resistance continuously changes.

8. The air-conditioning apparatus of claim 1, comprising:

an outdoor unit provided with the compressor, the flow switching valve, and the outdoor heat exchange unit;

a plurality of indoor units provided with a plurality of the expansion sections and a plurality of the indoor heat exchangers; and a relay interposed between the outdoor unit and the plurality of indoor units, and configured to distribute refrigerant supplied from the outdoor unit to the plurality of indoor units.

9. The air-conditioning apparatus of claim 1, wherein, in the heat exchange control mode in which the heat exchange amounts in the first flow rate control device and the second flow rate control device are controlled, the first flow rate control device, the second flow rate control device and the flow rate adjustment valve are controlled so as to decrease the amount of refrigerant flowing out from the second outdoor heat exchanger and to increase the amount of refrigerant flowing into the bypass pipe.

* * * * *